US005985181A

United States Patent [19]

Yoshida et al.

[11] Patent Number: 5,985,181

[45] Date of Patent: Nov. 16, 1999

[54] SEMICONDUCTIVE RESIN COMPOSITION AND PROCESS FOR PRODUCING THE SAME

[75] Inventors: Yoshie Yoshida; Toshikazu Mizutani; Masaki Kitagawa; Jichio Deguchi, all of Yokkaichi, Japan

[73] Assignee: Mitsubishi Chemical Corporation, Tokyo-to, Japan

[21] Appl. No.: 09/020,897

[22] Filed: Feb. 9, 1998

[30] Foreign Application Priority Data

Feb. 7, 1997 [JP] Japan ..... 9-024972

[51] Int. Cl.[6] ..... H01B 1/06

[52] U.S. Cl. ..... 252/511; 174/24; 428/383

[58] Field of Search ..... 252/511, 510, 252/62.3; 205/157–159; 102/68.1, 102; 525/242, 244, 55, 285, 288; 524/492, 496, 504, 588; 174/24; 428/383

[56] References Cited

U.S. PATENT DOCUMENTS

| | | | |
|---|---|---|---|
| 3,075,948 | 1/1963 | Santelli et al. | 260/44.5 |
| 4,908,411 | 3/1990 | Kinoshita et al. | 525/285 |
| 5,108,657 | 4/1992 | Demay et al. | 252/511 |

FOREIGN PATENT DOCUMENTS

| | | |
|---|---|---|
| 0 010 148 | 4/1980 | European Pat. Off. . |
| 1479596 | 3/1967 | France . |

OTHER PUBLICATIONS

Derwent Abstracts, AN 92–394623, JP 04 293945, Oct. 19, 1992.

Derwent Abstracts, AN 93–011650, JP 04 337336, Nov. 25, 1992.

*Primary Examiner*—Mark Kopec

*Assistant Examiner*—Derrick Go Hamlin

*Attorney, Agent, or Firm*—Oblon, Spivak, McClelland, Maier & Neustadt, P.C.

[57] ABSTRACT

There is provided a semiconductive resin composition comprising the following components (A), (B), (D) and (E):

(A) 5 to 100 parts by weight of a modified ethylene copolymer obtainable by subjecting an ethylene copolymer (a1) and a vinyl monomer (a2) to graft polymerization conditions, (B) 0.5 to 15 parts by weight of an unsaturated silane compound, (D) 10 to 110 parts by weight of carbon black, and (E) 0 to 95 parts by weight of an ethylene copolymer, provided that the amounts of the components shown above are based on 100 parts by weight in total of the components (A) and (E), wherein the component (B) is incorporated into the composition by subjecting the component (B) to melt graft reaction together with the component (A) and/or component (E) in the presence of 0.01 to 2 parts by weight of a radical generator (C), the vinyl monomer (a2) unit is contained in the composition in an amount of 5 to 35% by weight of the total amount of the components (A) and (E), and the degree of crosslinking of the composition is from 30 to 90% by weight.

10 Claims, No Drawings

SEMICONDUCTIVE RESIN COMPOSITION AND PROCESS FOR PRODUCING THE SAME

BACKGROUND OF THE INVENTION

1. Field of the Invention

This invention relates to a semiconductive resin composition which, when used as a coating on an insulating layer in a power cable, exhibits improved peelability from the insulating layer, and to a process for producing the same.

2. Background Art

In the field of power cables, there have conventionally been known cables of such a type that semiconductive layers are provided as the internal and external layers of an insulating layer for the purpose of decreasing the electrical field. It is necessary that these semiconductive layers be closely adhered to or bonded to the insulating layer so as to prevent the occurrence of corona discharge. However, when the external semiconductive layer and the insulating layer are excessively adhered to each other, it is extremely difficult to peel the external semiconductive layer from the insulating layer when, for example, two cables of this type are connected with each other. As a result, it takes long time to peel the external semiconductive layer from the insulating layer, and, in addition, the insulating layer tends to be damaged. The peeling operations thus require a considerable amount of time and labor, and a great deal of skill.

Semiconductive layers comprising as base resins ethylene-vinyl ester copolymers, which have been considered to be the most excellent semiconductive layers for use in the cables of this type, have the property of very strongly adhering to olefin polymers used for forming the insulating layer. It is therefore very difficult to peel the outer semiconductive layer from the insulating layer.

An object of the present invention is to provide a semiconductive resin composition suitable for use as a semiconductive layer, which adheres to an insulating layer with a sufficient strength but can be peeled very easily from the insulating layer when necessary and which has mechanical strength good enough for not easily being cut during peeling operation.

In the prior art, the following have been proposed as materials for semiconductive layers:

(1) those materials which are obtained by blending ethylene-vinyl ester copolymers such as ethylene-vinyl acetate copolymers (EVA) having high vinyl acetate contents or ethylene-ethyl acrylate copolymers, or ethylene-acrylic ester copolymers with carbon black;

(2) those materials which are obtained by adding carbon black to halogen-containing resins such as chlorinated polyethylene, chlorosulfonated polyethylene or EVA-vinyl chloride graft copolymers, or to mixtures of these halogen-containing resins and olefin polymers; and (3) those materials which are obtained by adding carbon black to blends of olefin polymers with polystyrenes, styrene copolymers, butadiene-acrylonitrile copolymers, polyesters or the like.

However, the above-described conventional semiconductive materials have the following drawbacks.

The materials (1) are, as mentioned previously, poor in the peelability from the insulating layer.

The materials (2) possess improved peelability from the insulating layer. However, the halogen-containing resins generate and emit corrosive gasses when thermally decomposed at high temperatures, and the gasses promote the corrosion of production apparatuses, or corrode copper shield tapes used for cables.

The materials (3) also show improved peelability from the insulating layer. However, they are poor in the compatibility between the olefin polymers and the other resins. Moreover, in order to attain sufficient peelability from the insulating layer, the amount of the resins to be blended with the olefin polymers should necessarily be large. Semiconductive layers made from such materials are considerably brittle, and thus undesirably cut during the peeling operations.

For use of the above-described materials (1), (2) and (3) as coating layers for power cables, the following two-step preparation process has been employed as so to impart thermal resistance to the materials: organic peroxides are added to the materials and the mixtures are molded at low temperatures; and the molded products are cross-linked by using a specific crosslinking apparatus.

On the other hand, as a method for attaining drastically increased productivity as compared with that attained by the above crosslinking method using organic peroxides (hereinafter referred to as peroxide crosslinking method), there has been proposed the silane crosslinking method. The silane crosslinking method is such that, after silane-containing polyolefins as described in Japanese Patent Publications No. 1711/1973 and No. 23777/1987, etc. are subjected to molding, the molded products are crosslinked in the presence of silanol condensation catalysts in an aqueous atmosphere. This silane crosslinking method is advantageous over the peroxide crosslinking method in that the crosslinking apparatus for use in this method is simpler than that for use in the conventional method and that the productivity attained by this method is much higher than that attained by the conventional method. For this reason, the use of a silane-crosslinked polyethylene for the insulating layers of low-voltage cables has been spread widely. Moreover, it has been proposed to apply a silane-crosslinked polyethylene also to semiconductive coatings in high-voltage cables, as disclosed in Japanese Patent Publication No. 31947/1995 and Japanese Patent Laid-Open Publication No. 293945/1992. However, the conventional silane-crosslinked polyethylene is still unsatisfactory in the peelability from the insulating layer of a power cable.

SUMMARY OF THE INVENTION

An object of the present invention is therefore to provide a semiconductive resin composition which is free from the aforementioned drawbacks in the prior art and which can fulfill the following requirements:

1) the resin composition, when used as a semiconductive coating layer on an insulating layer in a power cable, can adhere to the insulating layer with a sufficient strength;

2) the semiconductive layer can be easily peeled from the insulating layer, when necessary;

3) the semiconductive layer has good mechanical strength, and hardly cuts when peeled from the insulating layer;

4) carbon black can be thoroughly dispersed in the resin composition;

5) the resin composition has excellent extrusion molding properties;

6) the resin composition is excellent in thermal resistance, and does not emit corrosive gasses; and 7) the resin composition can be crosslinked by a simple process with high productivity.

It has now been found that the above object can be attained by using a resin obtainable by subjecting a specific modified ethylene copolymer to silane-grafting reaction. The present invention has been accomplished on the basis of this finding.

Thus, the present invention provides a semiconductive resin composition comprising the following components (A), (B), (D) and (E):

(A) 5 to 100 parts by weight of a modified ethylene copolymer obtainable by subjecting an ethylene copolymer (a1) and a vinyl monomer (a2) to graft polymerization conditions, (B) 0.5 to 15 parts by weight of an unsaturated silane compound, (D) 10 to 110 parts by weight of carbon black, and (E) 0 to 95 parts by weight of an ethylene copolymer, provided that the amounts of the components shown above are based on 100 parts by weight in total of the components (A) and (E), wherein the component (B) is incorporated into the composition by subjecting the component (B) to melt graft reaction together with the component (A) and/or component (E) in the presence of 0.01 to 2 parts by weight of a radical generator (C), the vinyl monomer (a2) unit is contained in the composition in an amount of 5 to 35% by weight of the total amount of the components (A) and (E), and the degree of crosslinking of the composition is from 30 to 90% by weight.

The present invention also provides a process for producing a semiconductive resin composition, comprising kneading the following components (A), (B), (D) and (E):

(A) 5 to 100 parts by weight of a modified ethylene copolymer obtainable by subjecting an ethylene copolymer (a1) and a vinyl monomer (a2) to graft polymerization conditions, (B) 0.5 to 15 parts by weight of an unsaturated silane compound, (D) 10 to 110 parts by weight of carbon black, and (E) 0 to 95 parts by weight of an ethylene copolymer, provided that the amounts of the components shown above are based on 100 parts by weight in total of the components (A) and (E), wherein the process comprises the step of subjecting the component (B) to melt graft reaction together with the component (A) and/or component (E) in the presence of 0.01 to 2 parts by weight of a radical generator (C).

DETAILED DESCRIPTION OF THE INVENTION

Component (A): Modified Ethylene Copolymer

The modified ethylene copolymer (A) for use in the present invention can be obtained by subjecting an ethylene copolymer (a1) and a vinyl monomer (a2) to graft polymerization conditions.

Ethylene Copolymer (a1)

The ethylene copolymer (a1) herein used is a copolymer of ethylene, main component, with one of, or two or more of the following components: α-olefins other than ethylene, such as propylene, butene and octene; and vinyl esters and unsaturated carboxylic acids or derivatives thereof such as esters, typically vinyl acetate, acrylic acid, methacrylic acid, acrylic ester and methacrylic ester. These ethylene copolymers also include those ones which are obtained by polymerization carried out by using single site catalysts. Of these, ethylene-vinyl acetate copolymers, ethylene-acrylic acid copolymers, ethylene-acrylate copolymers, ethylene-methacrylic acid copolymers, ethylene-methacrylate copolymers, and the like are preferred.

The ethylene copolymer (a1) contains generally 15 to 50% by weight, preferably 20 to 45% by weight, particularly 25 to 40% by weight of a monomer/monomers other than ethylene, selected from α-olefins other than ethylene, vinyl esters and unsaturated carboxylic acids or derivatives thereof such as esters. When the amount of the monomer(s) other than ethylene is smaller than the above-described range, the resulting resin composition tends to be insufficient in peelability. On the other hand, when the amount of the monomer(s) is larger than the above-described range, the resulting resin composition tends to have lowered thermal resistance.

It is preferable that the melt flow rate (MFR; at 190° C. under a load of 16 kg) of the ethylene copolymer (a1) be from 0.1 to 300 g/10 min, especially from 0.5 to 200 g/10 min, particularly from 1 to 100 g/10 min when aptitude for graft reaction, kneadability with carbon black and molding properties are taken into consideration.

Vinyl Monomer (a2)

Specific examples of the vinyl monomer (a2) to be subjected to graft polymerization conditions together with the above-described ethylene copolymer (a1) include unsaturated aromatic monomers such as styrene, 2-methylstyrene, 3-methylstyrene, 4-methylstyrene, dimethylstyrene and chlorostyrene; vinyl esters such as vinyl acetate and vinyl propionate; esters of acrylic or methacrylic acid such as methyl acrylate, ethyl acrylate, isopropyl acrylate, n-butyl acrylate, s-butyl acrylate, dodecyl acrylate, 2-ethylhexyl acrylate, hexyl acrylate, octyl acrylate, methyl methacrylate, ethyl methacrylate, n-butyl methacrylate, s-butyl methacrylate, decyl methacrylate, 2-ethylhexyl methacrylate and glycidyl methacrylate; unsaturated carboxylic acids or derivatives thereof such as acrylic acid, methacrylic acid, maleic anhydride, dimethyl maleate and bis(2-ethylhexyl) maleate; unsaturated nitriles such as acrylonitrile and methacrylonitrile; and unsaturated mono- or di-halides such as vinyl chloride and vinylidene chloride. Of these, styrene, ethyl acrylate and methyl methacrylate are preferred; and styrene is particularly preferred when the properties of the resulting modified ethylene copolymer (A) is taken into consideration and because the ethylene copolymer (a1) can easily be modified with styrene.

The amount of the vinyl monomer (a2) to be used is decided so that the vinyl monomer (a2) content of the resulting modified ethylene copolymer (A), which is the total amount of the vinyl monomer (a2) grafted to the ethylene copolymer (a1) and a homopolymer of the vinyl monomer (a2), can be generally 10 to 60% by weight, preferably 20 to 50% by weight. In general, however, the amount of the vinyl monomer (a2) used is almost equal to the vinyl monomer (a2) content. When the vinyl monomer (a2) content is lower than the above-described range, the compatibility-improving effect cannot be fully obtained. On the other hand, when the vinyl monomer (a2) content is higher than the above-described range, phase transition occurs, so that the compatibility-improving effect cannot be fully obtained also in this case.

Production of Modified Ethylene Copolymer (A)

As the radical generator for use in the production of the modified ethylene copolymer (A), which is conducted by subjecting the above-described ethylene copolymer (a1) and vinyl monomer (a2) to graft polymerization conditions, widely-used ones can be used. However, those radical generators whose decomposition temperatures are 50° C. or higher and which are oil-soluble are preferred when the preferable method of graft reaction, which will be described later, is taken into consideration.

When a radical generator whose decomposition temperature is lower than 50° C. is used, the polymerization of the vinyl monomer (a2) can proceed excessively, so that it is sometimes impossible to obtain a homogeneous modified ethylene copolymer (A). It is however possible to efficiently carry out the graft reaction by using a proper combination of a radical generator having a higher decomposition temperature and one having a lower decomposition temperature, and allowing them to decompose either stepwise or continuously.

Examples of radical generators useful in the present invention include organic peroxides such as 2,4-dichlorobenzoyl peroxide, t-butyl peroxy pivalate, o-methylbenzoyl peroxide, bis-3,5,5-trimethylhexanoyl peroxide, octanoyl peroxide, benzoyl peroxide, t-butyl peroxy-2-ethyl hexanoate, cyclohexanone peroxide, 2,5-dimethyl-2,5-dibenzoylperoxyhexane, t-butyl peroxy benzoate, di-t-butyl-diperoxy phthalate, methyl ethyl ketone peroxide, dicumyl peroxide and di-t-butyl peroxide; and azo compounds such as azobisisobutyronitrile and azobis(2,4-dimethylvaleronitrile).

The amount of the radical generator to be used is in the range of 0.01 to 10% by weight of the amount of the vinyl monomer (a2) used, and properly adjusted depending upon the type of the radical generator to be used and the reaction conditions to be employed. When the radical generator is used in an amount smaller than the above-described range, there is such a tendency that the reaction does not proceed smoothly. On the other hand, when the radical generator is used in an amount larger than the above-described range, gelled substances tend to be produced in the modified ethylene copolymer (A).

When the aforementioned components are subjected to graft polymerization reaction to obtain the modified ethylene copolymer (A), it is particularly preferable to employ an aqueous suspension grafting method as disclosed in Japanese Patent Publication No. 20266/1988. This is because the gel content can easily be controlled by this technique.

Thus, 100 parts by weight of ethylene copolymer (a1) particles having diameters of generally 1 to 7 mm, preferably 2 to 5 mm, 25 to 200 parts by weight of a vinyl monomer (a2), and 0.01 to 5 parts by weight for 100 parts by weight of the vinyl monomer (a2) of a radical generator having a decomposition temperature of 50 to 130° C. which makes the half life of the radical generator to 10 hours are added, in the presence of a suspending agent that is usually used for aqueous suspension polymerization, such as polyvinyl alcohol, polyvinyl pyrrolidone or methyl cellulose, or of a sparingly soluble inorganic material such as potassium phosphate or magnesium oxide, to an aqueous medium to any concentration at which the system can readily be stirred (in general, 5 to 100 parts by weight of the ethylene copolymer (a1) particles and vinyl monomer (a2) for 100 parts by weight of water), and dispersed by stirring. Successively, polymerization is carried out. Prior to the polymerization, this aqueous suspension is heated to a temperature at which the radical generator is not substantially decomposed, thereby infiltrating the vinyl monomer (a2) into the ethylene copolymer (a1) particles.

It is better to carry out the infiltration treatment by heating the aqueous suspension to a high temperature when the promotion of infiltration is taken into consideration. In this case, however, the vinyl monomer (a2) is homopolymerized before infiltrated into the ethylene copolymer (a1) particles due to the premature decomposition of the radical generator. To prevent this, it is better to carry out the infiltration treatment at a lower temperature, preferably at a temperature between room temperature and 50° C. The aqueous suspension is allowed to stand under such a temperature condition, preferably with stirring, for approximately 1 to 5 hours until 80% by weight or more, preferably 90% by weight or more of the vinyl monomer (a2) is infiltrated into or adhered to the ethylene copolymer (a1) particles, that is, until the amount of free vinyl monomer droplets becomes generally less than 20% by weight, preferably less than 10% by weight. In the case where the amount of the non-infiltrated vinyl monomer (a2) is larger than the above-described range, polymer particles of the independent vinyl monomer (a2) can separate out, and, in addition, the polymer of the vinyl monomer (a2) tends to be unevenly dispersed in the ethylene copolymer (a1) particles. In the subsequent step of polymerization, the free vinyl monomer (a2) is infiltrated into the ethylene copolymer (a1) particles, or adhered to the surfaces of the ethylene copolymer (a1) particles, and polymerized. For this reason, it is not actually found that polymer particles of the vinyl monomer (a2) are present independently of the ethylene copolymer (a1) particles.

The aqueous suspension thus prepared is further heated to a high temperature to complete the polymerization of the vinyl monomer (a2), thereby obtaining a modified ethylene copolymer (A). At this time, the aqueous suspension should be heated to a temperature at which the radical generator used is fully decomposed. It is however preferable to heat the aqueous suspension to a temperature not higher than 130° C. When it is heated to a temperature higher than 130° C., gelled substances tend to be produced in the modified ethylene copolymer (A). In general, therefore, it is proper to heat the aqueous suspension to a temperature between 50 to 130° C.

In the modified ethylene copolymer (A) thus obtained, three components, that is, the ethylene copolymer (a1), the vinyl monomer (a2)-grafted ethylene copolymer and the polymer of the vinyl monomer (a2) are present. The presence of the grafted component improves the compatibility between the ethylene copolymer (a1) and the polymer of the vinyl monomer (a2). The polymer of the vinyl monomer (a2) is thus finely and homogeneously dispersed in the ethylene copolymer (a1) matrix. For this reason, even if the vinyl monomer (a2) unit is increased, the homogeneity thereof is not marred, and the resulting molded products can show excellent appearance and physical properties. In contrast to this, in a system obtained by simply blending the ethylene copolymer (a1) and the polymer of the vinyl monomer (a2), the polymer of the vinyl monomer (a2) is unevenly dispersed in the ethylene copolymer (a1) because the compatibility between the two components is poor. Delamination thus occurs in the resulting resin composition during the step of molding, making the appearance of the molded product poor. Moreover, the resin composition has drastically impaired physical properties. Thus, a simple blend of these two components is unsuitable for practical use.

The amount of this modified ethylene copolymer (A) to be used is generally 5 to 100 parts by weight, preferably 5 to 95 parts by weight, particularly 20 to 80 parts by weight for 100 parts by weight in total of this component (A) and the component (E) which will be described later, polymer components. When the modified ethylene copolymer (A) is used in an amount smaller than the above-described range, the resulting resin composition is insufficient in peelability and mechanical strength.

Further, the amount of the aforementioned vinyl monomer (a2) unit contained in the resin composition of the present invention is from 5 to 35% by weight of the total amount of the component (A) and the component (E) which will be described later.

Component (B): Unsaturated Silane Compound

The unsaturated silane compound (B) for use in the present invention preferably includes those compounds which are represented by the following general formula:

$RSiR'_nY_{3-n}$ wherein R is an ethylenically unsaturated hydrocarbon or hydrocarbon oxy group having radical reactivity, such as vinyl, allyl, butenyl, cyclohexenyl, cyclopentadienyl or gamma-(meth)acryloxypropyl; R' is an aliphatic saturated hydrocarbon group such as methyl, ethyl, propyl, decyl or phenyl; Y represents a hydrolyzable organic group such as methoxy, ethoxy, formyloxy, acetoxy, propionyloxy, alkyl or arylamino; and n is an integer of 0 to 2.

Particularly preferable unsaturated silane compounds are those represented by the following general formula:

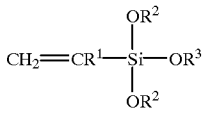

wherein $R^1$ is H or $CH_3$, $R^2$ is a linear or branched alkyl group having not more than 4 carbon atoms, and $R^3$ is identical with $R^2$, or represents a linear or branched alkyl group having not more than 4 carbon atoms, or phenyl group. Specific examples of such compounds include vinyltrimethoxysilane, vinyltriethoxysilane, vinyltripropoxysilane, vinyltriacetoxysilane, vinylmethyldiethoxysilane and vinylethyldimethoxysilane.

Other particularly preferable unsaturated silane compounds are those represented by the following general formula:

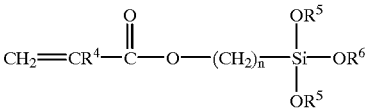

wherein $R^4$ is H or $CH_3$, $R^5$ is a linear alkyl group having not more than 4 carbon atoms, and $R^6$ is identical with $R^5$, or represents a linear alkyl group having not more than 4 carbon atoms or phenyl group, and n is an integer of 1 to 6.

A typical example of such compounds is γ-methacryloxypropylmethoxysilane.

The amount of the unsaturated silane compound (B) to be used is decided depending upon the desired degree of crosslinking, the reaction conditions to be employed, and the like. In general, however, this amount is from 0.5 to 15 parts by weight, preferably from 0.7 to 13 parts by weight, particularly from 1 to 10 parts by weight for 100 parts by weight in total of the polymer components, that is, the above-described component (A) and the component (E) which will be described later, when economical efficiency, handling before and during the process of reaction, and the like are taken into consideration. When the component (B) is used in an amount smaller than the above-described range, only a low graft ratio is obtained, and sufficiently high degree of crosslinking cannot be attained. Crosslinking is only slightly affected also in the case where the component (B) is used in an amount larger than the above-described range. In this case, the resulting molded products tend to have poor appearance due to the volatilization of the unreacted unsaturated silane compound (B), or the like.

Component (C): Radical Generator

Any compound capable of generating free radicals under reaction conditions, having a half life of shorter than 6 minutes at a reaction temperature can be used in the present invention as the radical generator (C). Any radical generator having a half life of shorter than 1 minute is preferably used, and all of the compounds described in Japanese Patent Publication No. 1711/1973 can be used in the present invention. Examples of those radical generators which are often used in the present invention include organic peroxides such as benzoyl peroxide, dicumyl peroxide, di-t-butyl peroxide and t-butyl peroxy-2-ethyl hexanoate, and azo compounds such as azobisiso-butyronitrile and methyl azobisisobutyrate.

The radical generator (C) is used in an amount of generally 0.01 to 2 parts by weight, preferably 0.05 to 1.5 parts by weight for 100 parts by weight in total of the polymer components, that is, the above-described component (A) and the component (E) which will be described later. When this component (C) is used in an amount smaller than the above-described range, only a small amount of the unsaturated silane compound (B) can be grafted. On the other hand, when the component (C) is used in an amount larger than the above-described range, undesired crosslinking often proceeds. Therefore, the resulting resin composition tends to be poor in flow properties, and the molded products tend to have poor appearance.

Component (D): Carbon Black

Any carbon black can be used in the present invention as the component (D) as long as it can impart desired semiconductivity to the resin composition of the present invention. Even carbon black having low electrical conductivity can impart desired semiconductivity to the resin composition if it is used in a relatively large amount.

Examples of carbon blacks useful herein include commercially available furnace black, acetylene black, kettchen black, channel black and thermal black. The amount of the carbon black to be used is generally from 10 to 110 parts by weight, preferably from 20 to 90 parts by weight, particularly from 40 to 80 parts by weight for 100 parts by weight in total of the above-described component (A) and the component (E) which will be described later, polymer components. When the carbon black is used in an amount smaller than the above-described range, the resin composition cannot acquire good semiconductivity. On the other hand, when the carbon black is used in an amount larger than the above-described range, the resulting resin composition tends to have impaired extrusion properties and mechanical properties.

Component (E): Ethylene Copolymer

The ethylene copolymer (E) for use in the present invention can properly be selected from the previously-mentioned ethylene copolymers useful as the ethylene copolymer (a1) which is a constituent of the component (A).

An ethylene copolymer of a type different from that of the ethylene copolymer (a1) can be selected as the ethylene copolymer (E). However, when the compatibility between these two ethylene copolymers is taken into consideration, it is preferable to select an ethylene copolymer of the same type as that of the ethylene copolymer (a1). Further, in the ethylene copolymer (E), it is preferable that the amount of the monomer(s) other than ethylene be in the previously-mentioned range. However, it does not matter even if an ethylene copolymer (E) in which the amount of the monomer(s) copolymerized with ethylene is different from that in the ethylene copolymer (a1) is used.

The amount of the ethylene copolymer (E) to be used is generally from 0 to 95 part by weight, preferably from 5 to 95 parts by weight, particularly from 20 to 80 parts by weight for 100 parts by weight in total of the previously-mentioned component (A) and this component (E), polymer components. When the component (E) is used in an amount larger than the above-described range, the resulting resin composition is insufficient in peelability.

Optional Components

To the resin composition of the present invention, it is also possible to add, when necessary, other components, for instance, additives such as antioxidants, weathering agents, ultraviolet absorbers and corrosion inhibitors, and optional components such as lubricants, adhesive agents and dispersants as long as they do not remarkably mar the effects of the present invention.

Semiconductive Resin Composition & Process for Producing the Same

The semiconductive resin composition of the present invention comprises the aforementioned components, that is, the following components (A), (B), (D) and (E):

(A) 5 to 100 parts by weight of the modified ethylene copolymer obtainable by subjecting the ethylene copolymer (a1) and the vinyl monomer (a2) to graft polymerization conditions, (B) 0.5 to 15 parts by weight of the unsaturated silane compound, (C) 10 to 110 parts by weight of the carbon black, and (D) 0 to 95 parts by weight of the ethylene copolymer, provided that the amounts of the components shown above are based on 100 parts by weight in total of the components (A) and (E), wherein the component (B) is incorporated into the composition by subjecting the component (B) to melt graft reaction together with the component (A) and/or component (E) and 0.01 to 2 parts by weight of the radical generator (C); the vinyl monomer (a2) unit is contained in the composition in an amount of 5 to 35% by weight of the total amount of the components (A) and (E); and the degree of crosslinking of the composition is from 30 to 90% by weight.

In this semiconductive resin composition, the component (B) is incorporated into the resin composition by subjecting the component (B) to melt graft reaction together with the component (A) and/or component (E). The component (D) may also be allowed to exist when this melt graft reaction is carried out.

Specifically, the following four processes can be mentioned as typical processes for producing the semiconductive resin composition of the present invention.

Process 1

A process in which 100 parts by weight of a resin consisting of 5 to 100 parts by weight of the modified ethylene copolymer (A) and 0 to 95 parts by weight of the ethylene copolymer (E), and 10 to 110 parts by weight of the carbon black (D) are melt-kneaded; to this mixture are added 0.5 to 15 parts by weight of the unsaturated silane compound (B) and 0.01 to 2 parts by weight of the radical generator (C); and the resulting mixture is further melt-kneaded to carry out silane-grafting reaction, thereby obtaining a semiconductive resin composition.

Process 2

A process in which 100 parts by weight of a resin consisting of 5 to 100 parts by weight of the modified ethylene copolymer (A) and 0 to 95 parts by weight of the ethylene copolymer (E), 0.5 to 15 parts by weight of the unsaturated silane compound (B) and 0.01 to 2 parts by weight of the radical generator (C) are melt-kneaded to carry out silane-grafting reaction, thereby obtaining an unsaturated silane compound-grafted ethylene copolymer; 10 to 110 parts by weight of the carbon black (D) is added to this copolymer; and the mixture is further melt-kneaded to obtain a semiconductive resin composition.

Process 3

A process in which 100 parts by weight of a resin consisting of 5 to 100 parts by weight of the modified ethylene copolymer (A) and 0 to 95 parts by weight of the ethylene copolymer (E), 0.5 to 15 parts by weight of the unsaturated silane compound (B), 0.01 to 2 parts by weight of the radical generator (C) and 10 to 110 parts by weight of the carbon black (D) are melt-kneaded to carry out silane-grafting reaction, thereby obtaining a semiconductive resin composition.

Process 4

A process in which 20 to 80 parts by weight of the modified ethylene copolymer (A), 0.5 to 15 parts by weight of the unsaturated silane compound (B) and 0.01 to 2 parts by weight of the radical generator (C) are melt-kneaded to carry out silane-grafting reaction, thereby obtaining an unsaturated silane compound-grafted modified ethylene copolymer; 10 to 110 parts by weight of the carbon black (D) is added to a resin consisting of the unsaturated silane compound-grafted modified ethylene copolymer and 20 to 80 parts by weight of the ethylene copolymer (E); and the mixture is further melt-kneaded to obtain a semiconductive resin composition.

Process 5

A process in which 20 to 80 parts by weight of the ethylene copolymer (E), 0.5 to 15 parts by weight of the unsaturated silane compound (B) and 0.01 to 2 parts by weight of the radical generator (C) are melt-kneaded to carry out silane-grafting reaction, thereby obtaining an unsaturated silane compound-grafted ethylene copolymer; 10 to 110 parts by weight of the carbon black (D) is added to a resin consisting of the unsaturated silane compound-grafted ethylene copolymer and 20 to 80 parts by weight of the modified ethylene copolymer (A); and the mixture is further melt-kneaded to obtain a semiconductive resin composition.

In the above-described processes, the melt kneading is usually conducted by using a conventional kneader such as a single-screw kneader, twin-screw kneader, Banbury mixer or roll mill. A twin-screw kneader and Banbury mixer are preferred from the viewpoint of efficiency. Further, in these processes, a silanol condensation catalyst can be introduced, when necessary, into the mixture at the latter stage, or at the step of final kneading. Moreover, the resin composition obtained can be subjected to molding immediately after the melt kneading.

Examples of silanol condensation catalysts useful herein include metallic carboxylates such as tin, zinc, iron, lead and cobalt carboxylates, organometallic compounds such as titanate and chelate compounds, organic bases, inorganic acids, and organic acids. For example, there can be mentioned dibutyltin dilaurate, dibutyltin diacetate, dioctyltin dilaurate, stannous acetate, stannous caprylate, lead naphthenate, zinc caprylate, cobalt naphthenate, tetrabutyl titanate, tetranoenyl titanate, ethyl amine, dibutyl amine, hexyl amine, pyridine, inorganic acids such as sulfuric acid and hydrochloric acid, and organic acids such as toluenesulfonic acid, acetic acid, stearic acid and maleic acid.

The amount of the silanol condensation catalyst to be added is generally from 0.001 to 10 parts by weight, preferably from 0.01 to 5 parts by weight, particularly from 0.01 to 1 part by weight for 100 parts by weight of the copolymer (resin) components.

The silanol condensation catalyst can be added to the resin composition before the resin composition is subjected to molding. Alternatively, a solution or dispersion of the silanol condensation catalyst can be applied to or infiltrated into the molded product. Further, in the case where a layer of the semiconductive resin composition of the present invention is used along with a layer of a polyolefin resin to form a laminate, the silanol condensation catalyst may be added to either one of or both of the two layers.

For the purpose of imparting thermal resistance to the molded product, the above-obtained molded product containing the silanol condensation catalyst can be crosslinked by exposing it to water.

The exposure to water can be conducted by bringing the molded product into contact with water (in a state of liquid or vapor) at a temperature ranging from room temperature to approximately 200° C., generally at a temperature ranging from room temperature to approximately 100° C. for about 10 seconds to one week, generally for about 1 minute to one day. The molded product can also be brought into contact with water under pressure. Wetting agents, surface active agents, aqueous organic solvents, etc. may also be added to the water in order to improve the wetting of the molded product. The water may be not only ordinary water but also in a state of hot water vapor, or of moisture contained in the air. Further, by exposing the resin composition of the present invention to water during the process of production and also during the process of molding, the crosslinking of the resin composition can be carried out simultaneously with the production and molding of the resin composition.

The degree of crosslinking of the resin composition of the present invention is from 30 to 90% by weight. When the resin composition has a degree of crosslinking lower than 30% by weight, the resulting molded product is insufficient in thermal resistance. On the other hand, when the resin composition has a degree of crosslinking higher than 90% by weight, the resulting molded product shows remarkably impaired extensibility, and thus tends to be brittle.

Molding

The semiconductive resin composition of the present invention can be molded into a desired product by a conventional molding method such as film extrusion, co-extrusion molding or calendaring. It is most preferred to mold the resin composition into a semiconductive coating layer which is to be laminated onto an insulating layer of a polyolefin resin in a power cable since in this case the composition of the present invention can best exhibit its improved peelability. Thus, in this case, a power cable comprises a core conductor, an internal semiconductive layer, an insulating layer and an external semiconductive layer made of the semiconductive resin composition of the present invention. The internal semiconductive layer may also be made of the composition of the present invention. Further, it is preferred that the insulating layer be made of a copolymer of an unsaturated silane compound, especially a copolymer of ethylene and an unsaturated silane compound.

EXAMPLES

The following examples illustrate the present invention but are not intended to limit it.

Methods of evaluation tests employed in the examples are as follows.

Peel Test

A semiconductive resin composition was introduced into an extruder having an L/D ratio of 26 and a bore diameter of 20 mm. On the other hand, a dry blend of 100 parts by weight of the ethylene-unsaturated silane compound copolymer of Referential Example 1 and 5 parts by weight of the silanol condensation catalyst master batch 1 of Referential Example 3 was introduced into an extruder having an L/D ratio of 28 and a bore diameter of 30 mm. Thus, a sample sheet was prepared by means of two-layer co-extrusion sheet forming, using a T-shaped two-layer molder, the temperature of the die being set at 190° C. The sample sheet obtained was composed of the semiconductive resin composition layer having a thickness of 1 mm, and the silane-modified polyethylene layer having a thickness of 2 mm. This two-layer sheet was dipped in hot water at 85° C. for 12 hours for crosslinking. A test specimen having a length in the direction of the flow of the resin of 20 cm and a width of 0.5 inches was cut out from the sheet. By the use of this specimen, a peel test was carried out in an atmosphere of 23° C. and 50 RH % at a peel angle of 180 degrees, at a peel rate of 200 mm/min. The peel strength was thus measured.

Further, when the peel test was carried out, the specimen was visually observed whether or not the residue of the semiconductive resin composition (carbon residue) was present on the silane-modified polyethylene layer.

Degree of Crosslinking

Extraction was made by using a Soxhlet apparatus, and xylene as a solvent. A sample placed in xylene was heated at the boiling point of the solvent for approximately 12 hours. The degree of crosslinking expressed in percentage by weight was determined from the following equation:

Degree of crosslinking (%)=[Weight of the extract residue (g)/Weight of the sample before subjected to extraction (g)]×100

Tensile Strength

Measured in accordance with JIS K-7113.

Styrene Content of Resin Composition

Determined by using an infrared spectrophotometer. A quantitative analysis was carried out with respect to a peak at 1935 $cm^{-1}$ characteristic of aromatic ring, appearing in the infrared spectrum of the resin composition.

A calibration curve was obtained in the following manner: mixtures of ethylene-vinyl acetate copolymer and polystyrene, having styrene contents of 0, 10, 20, 30, 40 and 50% by weight were respectively melt-kneaded in a Brabender Plastograph; the uniform mixtures obtained were respectively made into pressed sheets, each having a thickness of 1 mm; and by using these pressed sheets as standard samples, a calibration curve was obtained by means of regression calculation.

Percentage Deformation under Heat and Load

A test specimen of 30 mm×20 mm was cut out from the semiconductive resin composition layer of the sample sheet prepared in [Peel Test] above, and placed between pressure plates. Pressure was applied to the specimen at 120° C. for 1 hour by placing a weight (1 kg) on the pressure plate, and the degree of change in the thickness of the specimen was determined by using a dial gauge. The percentage deformation under heat and load was calculated from the following equation:

Percentage deformation under heat and load (%)=[Difference in the thickness of the specimen before and after the application of pressure (mm)/Original thickness of the specimen (mm)]×100

Materials used in the below-described Examples and Comparative Examples were prepared in the following manners.

Referential Example 1

Ethylene-Unsaturated Silane Compound Copolymer

By feeding a mixture of ethylene, vinyltrimethoxysilane and propylene serving as a molecular weight modifier, and t-butyl peroxy isobutyrate serving as a radical generator to a 1.5 litter reactor equipped with a stirrer, reaction was continuously carried out under the following conditions:

| feed rate: | |
|---|---|
| ethylene | 43 kg/h |
| vinyltrimethoxysilane | 0.20 kg/h |
| propylene | 0.45 kg/h |
| t-butyl peroxy isobutyrate | 2.3 kg/h |
| temperature of monomers fed: | 65° C. |
| polymerization pressure: | 2,400 kg/cm$^2$ |
| maximum reaction temperature: | 225° C. |
| output rate: | 5.5 kg/h |

The ethylene-unsaturated silane compound copolymer obtained was found to have a density of 0.923 g/cm$^3$, an MFR of 0.9 g/10 min, and a vinyltrimethoxysilane content of 1.2% by weight. The degree of crosslinking of the copolymer after the above-described crosslinking treatment was 78% by weight.

Referential Example 2

Unsaturated Silane Compound-Grafted Polyethylene 100 parts by weight of low-density polyethylene having a density of 0.919 g/cm$^3$ and an MFR of 2.0 g/10 min, 2 parts by weight of vinyltrimethoxysilane and 0.08 parts by weight of dicumyl peroxide were subjected to graft reaction at a temperature of 190° C. by using a single-screw extruder having an L/D ratio of 28 and a bore diameter of 40 mm, the residence time in the extruder being 1.7 minutes, thereby obtaining an unsaturated silane compound-grafted polyethylene. The polyethylene thus obtained was found to have a density of 0.920 g/cm$^3$, an MFR of 0.8 g/10 min, and a vinyltrimethoxysilane content of 1.2% weight. The degree of crosslinking of the polyethylene after crosslinking treatment was 75% by weight.

Referential Example 3

Silanol Condensation Catalyst Master Batch 1

In 100 parts by weight of polyethylene having a density of 0.919 g/cm$^3$ and an MFR of 2.0 g/10 min, 1 part by weight of dibutyltin dilaurate, 1 part by weight of 4,4'-thiobis(2-t-butyl-m-cresol), 1 part by weight of 2,2'-oxamide-bis[ethyl-3-(3,5,-di-t-butyl-4-hydroxypheyl) propionate] and 1 part by weight of zinc stearate were uniformly dispersed by using a twin-screw kneader at a temperature of 180° C., the residence time in the kneader being 0.7 minutes. A silanol condensation catalyst master batch having a density of 0.925 g/cm$^3$, an MFR of 3.0 g/10 min, and a catalyst concentration of 1% by weight was thus obtained.

Referential Example 4

Modified Ethylene Copolymer 1

In a 50 litter autoclave, 20 kg of pure water, and 600 g of tribasic calcium phosphate and 0.6 g of sodium dodecylbenzenesulfonate as suspending agents, were placed to form an aqueous medium. In this aqueous medium, 6 kg of ethylene-vinyl acetate copolymer (EVA: vinyl acetate content 33% by weight, MFR 30 g/10 min) particles having a diameter of 3 mm were suspended by stirring. Separately, 8 g of benzoyl peroxide and 4 g of t-butyl peroxy benzoate as polymerization initiators were dissolved in 6 kg of styrene (100 parts by weight for 100 parts by weight of EVA). This solution was introduced into the above-prepared suspension system, and the temperature of the inside of the autoclave was raised to 50° C. The autoclave was held at the temperature for 3 hours to infiltrate the styrene containing the polymerization initiators into the ethylene-vinyl acetate copolymer particles.

This aqueous suspension was held at 60° C. for 7 hours, and at 85° C. for 5 hours to complete the polymerization. It was confirmed that styrene polymer was present in the modified polymer particles in an amount almost equal to the amount of the styrene fed that is, in an amount of approximately 100 parts by weight.

Referential Example 5

Modified Ethylene Copolymer 2

The procedure of Referential Example 4 was repeated except that the ethylene-vinyl acetate copolymer used in Referential Example 4 was replaced by an ethylene-vinyl acetate copolymer having a vinyl acetate content of 28% by weight and an MFR of 15 g/10 min, thereby obtaining a modified ethylene-vinyl acetate copolymer.

Referential Example 6

Modified Ethylene Copolymer 3

The procedure of Referential Example 5 was repeated except that the amount of the styrene was changed to 25 parts by weight, thereby obtaining a modified ethylene-vinyl acetate copolymer.

Referential Example 7

Modified Ethylene Copolymer 4

The procedure of Referential Example 4 was repeated except that the ethylene-vinyl acetate copolymer used in Referential Example 4 was replaced by an ethylene-ethyl acrylate copolymer having an ethyl acrylate content of 25% by weight and an MFR of 5 g/10 min, thereby obtaining a modified ethylene-ethyl acrylate copolymer.

Example 1

A semiconductive resin composition was produced in accordance with the above-described [Process 1].

100 parts by weight of a copolymer (resin) component consisting of 60 parts by weight of an ethylene-vinyl acetate copolymer having a vinyl acetate content of 33% by weight and 40 parts by weight of the modified ethylene copolymer 1 prepared in Referential Example 4, and 40 parts by weight of furnace black ( "Vulcan XC72" manufactured by Cabot Corp., DBP (dibutyl phthalate) absorption 178 cc/100 g) were melt-kneaded in a twin-screw kneader. To this intimate mixture were added 3 parts by weight of vinyltrimethoxysilane and 0.4 parts by weight of t-butyl peroxy-2-ethyl hexanoate. The mixture was melt-kneaded at a temperature of 190° C. in a single-screw extruder to carry out silane-grafting reaction, the residence time in the extruder being 1.5 minutes, thereby obtaining a semiconductive resin composition.

Separately, 60 parts by weight of the above-described ethylene-vinyl acetate copolymer having a vinyl acetate content of 33% by weight, and 40 parts by weight of the modified ethylene copolymer 1 of Referential Example 4 were melt-kneaded in a Brabender Plastograph. The mixture was press-molded at 160° C. into a sheet sample having a thickness of 1 mm for use in the above-described measurement of styrene content.

For the semiconductive resin composition obtained above, the above measurements were carried out. The results are shown in Table 1.

Example 2

The procedure of Example 1 was repeated except that the furnace black used in Example 1 was replaced by 55 parts by weight of acetylene black ("Denka Black" manufactured by Denki Kagaku Kogyo K.K., Japan; DBP absorption 125 cc/100 g) and that the amount of the t-butyl peroxy-2-ethyl hexanoate was changed to 0.25 parts by weight. The results are shown in Table 1.

Example 3

The procedure of Example 1 was repeated except that the copolymer component used in Example 1 was replaced by a copolymer component consisting of 80 parts by weight of an ethylene-vinyl acetate copolymer having a vinyl acetate content of 28% by weight and 20 parts by weight of the modified ethylene copolymer 2 prepared in Referential Example 5. The results are shown in Table 1.

Example 4

The procedure of Example 1 was repeated except that the copolymer component used in Example 1 was replaced by a copolymer component consisting of 5 parts by weight of an ethylene-vinyl acetate copolymer having a vinyl acetate content of 28% by weight and 95 parts by weight of the modified ethylene copolymer 3 prepared in Referential Example 6. The results are shown in Table 1.

Example 5

The procedure of Example 1 was repeated except that the copolymer component used in Example 1 was replaced by a copolymer component consisting of 60 parts by weight of an ethylene-ethyl acrylate copolymer having an ethyl acrylate content of 25% by weight and 40 parts by weight of the modified ethylene copolymer 4 prepared in Referential Example 7 and that the t-butyl peroxy-2-ethyl hexanoate used in Example 1 was replaced by 0.07 parts by weight of dicumyl peroxide. The results are shown in Table 1.

Comparative Example 1

The procedure of Example 1 was repeated except that the copolymer component used in Example 1 was replaced by 100 parts by weight of an ethylene-vinyl acetate copolymer having a vinyl acetate content of 33% by weight. The results are shown in Table 1.

Comparative Example 2

The procedure of Example 1 was repeated except that the copolymer component used in Example 1 was replaced by a copolymer component consisting of 80 parts by weight of an ethylene-vinyl acetate copolymer having a vinyl acetate content of 33% by weight and 20 parts by weight of polystyrene (instead of the modified ethylene copolymer 1). The results are shown in Table 1.

Example 6

The procedure of Example 1 was repeated except that the ethylene-unsaturated silane compound copolymer of Referential Example 1 used for the preparation of the two-layer sample sheet for the measurement of peel strength was replaced by the unsaturated silane compound-grafted polyethylene prepared in Referential Example 2. The results are shown in Table 1.

Example 7

A semiconductive resin composition was prepared in accordance with the above-described [Process 2].

To 100 parts by weight of a copolymer (resin) component consisting of 60 parts by weight of an ethylene-vinyl acetate copolymer having a vinyl acetate content of 33% by weight and 40 parts by weight of the modified ethylene copolymer 1 prepared in Referential Example 4 were added 2 parts by weight of vinyltrimethoxysilane and 0.3 parts by weight of t-butyl peroxy-2-ethyl hexanoate. The mixture was melt-kneaded to carry out silane-grafting reaction at a temperature of 190° C. by using a single-screw extruder having an L/D ratio of 28 and a bore diameter of 40 mm, the residence time in the extruder being 1.7 minutes. 100 parts by weight of the reaction product, and 40 parts by weight of the same furnace black as used in Example 1 were melt-kneaded by using a same-direction twin-screw extruder having a screw diameter of 45 mm under the following conditions: the temperature was 180° C.; the number of revolutions was 250 rpm; and the output rate was 20 kg/hour. A semiconductive resin composition was thus obtained.

For the semiconductive resin composition obtained, the same measurements as in Example 1 were conducted. The results are shown in Table 1.

Example 8

A semiconductive resin composition was produced in accordance with the above-described [Process 3].

100 parts by weight of a copolymer (resin) component consisting of 60 parts by weight of an ethylene-vinyl acetate copolymer having a vinyl acetate content of 33% by weight and 40 parts by weight of the modified ethylene copolymer 1 prepared in Referential Example 4, 2 parts by weight of vinyltrimethoxy-silane, 0.3 parts by weight of t-butyl peroxy-2-ethyl hexanoate, and 40 parts by weight of the same furnace black as that used in Example 1 were blended. The blend was melt-kneaded to carry out silane-grafting reaction at a temperature of 190° C. by using a same-direction twin-screw extruder having a screw diameter of 30 mm, connected with a two-layer molder, the residence time in the extruder being 0.9 minutes. While carrying out the silane-grafting reaction, a dry blend of 100 parts by weight of the ethylene-unsaturated silane compound copolymer prepared in Referential Example 1 and 5 parts by weight of the silanol condensation catalyst master batch 1 prepared in Referential Example 3 was introduced into an extruder having an L/D ratio of 28 and a bore diameter of 30 mm, connected with the two-layer molder. A two-layer sample sheet as described in [Peel Test] above was thus obtained. The results of measurements are shown in Table 1.

TABLE 1

| | Ex. 1 | Ex. 2 | Ex. 3 | Ex. 4 | Ex. 5 | Ex. 6 | Ex. 7 | Ex. 8 | Comp. Ex. 1 | Comp. Ex. 2 |
|---|---|---|---|---|---|---|---|---|---|---|
| Formulation (parts by weight) | — | — | — | — | — | — | — | — | — | — |
| EVA (VA 28%, MFR 15) | — | — | 80 | 5 | — | — | — | — | — | — |
| EVA (VA 33%, MFR 30) | 60 | 60 | — | — | — | 60 | 60 | 60 | 100 | 80 |

TABLE 1-continued

| | Ex. 1 | Ex. 2 | Ex. 3 | Ex. 4 | Ex. 5 | Ex. 6 | Ex. 7 | Ex. 8 | Comp. Ex. 1 | Comp. Ex. 2 |
|---|---|---|---|---|---|---|---|---|---|---|
| EEA (EA 25%, MFR 5) | — | — | — | — | 60 | — | — | — | — | — |
| Modified ethylene copolymer of Ref. Ex. 4 | 40 | 40 | — | — | — | 40 | 40 | 40 | — | — |
| Modified ethylene copolymer of Ref. Ex. 5 | — | — | 20 | — | — | — | — | — | — | — |
| Modified ethylene copolymer of Ref. Ex. 6 | — | — | — | 95 | — | — | — | — | — | — |
| Modified ethylene copolymer of Ref. Ex. 7 | — | — | — | — | 40 | — | — | — | — | — |
| Polystyrene | — | — | — | — | — | — | — | — | — | 20 |
| Styrene content of resin composition (wt %) | 20 | 20 | 10 | 19 | 20 | 20 | 21 | 20 | 0 | 20 |
| Vinyltrimethoxysilane | 3 | 3 | 3 | 3 | 3 | 3 | 2 | 2 | 3 | 3 |
| t-Butyl peroxy-2-ethyl hexanoate | 0.4 | 0.25 | 0.4 | 0.4 | — | 0.4 | 0.3 | 0.3 | 0.4 | 0.4 |
| Dicumyl peroxide | — | — | — | — | 0.07 | — | — | — | — | — |
| Furnace black | 40 | — | 40 | 40 | 40 | 40 | 40 | 40 | 40 | 40 |
| Acetylene black | — | 55 | — | — | — | — | — | — | — | — |
| Zinc stearate | 0.5 | 0.5 | 0.5 | 0.5 | 0.5 | 0.5 | 0.5 | 0.5 | 0.5 | 0.5 |
| Evaluation | | | | | | | | | | |
| Peel strength (kg/0.5 inches) | 0.7 | 1.7 | 1.5 | 0.6 | 1.5 | 0.8 | 1.0 | 1.0 | substrate layer was fractured | unmeasurable |
| Carbon residue | none | none | none | none | none | none | none | none | much | — |
| Tensile strength (MPa) | 15 | 15 | 14 | 17 | 14 | 15 | 15 | 14 | 6 | 3 |
| Degree of crosslinking (wt %) | 70 | 72 | 72 | 65 | 73 | 70 | 73 | 69 | 72 | 68 |

(Note)
EVA: ethylene-vinyl acetate copolymer
EEA: ethylene-ethyl acrylate copolymer
unmeasurable: Delamination occured in the semiconductive resin composition itself due to uneven dispersion of the components in the resin composition.

Example 9

A semiconductive resin composition was produced in accordance with the above-mentioned [Process 1].

100 parts by weight of a copolymer (resin) component consisting of 40 parts by weight of an ethylene-vinyl acetate copolymer having a vinyl acetate content of 33% by weight and 60 parts by weight of the modified ethylene copolymer 1 prepared in Referential Example 4, and 40 parts by weight of the same furnace black as used in Example 1 were melt-kneaded by using a twin-screw kneader. To this intimate mixture were added 3 parts by weight of vinyltrimethoxysilane and 0.4 parts by weight of t-butyl peroxy-2-ethyl hexanoate. The mixture was melt-kneaded to carry out silane-grafting reaction at a temperature of 190° C. by using a single-screw extruder, the residence time in the extruder being 1.5 minutes, thereby obtaining a semiconductive resin composition (A).

The results of measurements are shown in Table 2.

Example 10

To 100 parts by weight of an ethylene-vinyl acetate copolymer having a vinyl acetate content of 33% by weight were added 2 parts by weight of vinyltrimethoxysilane, and 0.35 parts by weight of t-butyl peroxy octate. The mixture was melt-kneaded to carry out silane-grafting reaction at a temperature of 190° C. by using a single-screw extruder having an L/D ratio of 28 and a bore diameter of 40 mm, the residence time in the extruder being 1.7 minutes, thereby obtaining an unsaturated silane compound-grafted ethylene-vinyl acetate copolymer. 100 parts by weight of a copolymer (resin) component prepared by dry-blending 40 parts by weight of the unsaturated silane compound-grafted ethylene-vinyl acetate copolymer and 60 parts by weight of the modified ethylene copolymer 1 prepared in Referential Example 4, and 40 parts by weight of the same furnace black as used in Example 1 were melt-kneaded by using a same-direction twin-screw extruder having a screw diameter of 45 mm under the following conditions: the temperature was 180° C.; the number of revolutions was 250 rpm; and the output rate was 20 kg/hour. A semiconductive resin composition (B) was thus obtained.

The results of measurements are shown in Table 2.

Comparative Example 3

The procedure of Example 9 was repeated except for not using the t-butyl peroxy-2-ethyl hexanoate as a radical generator to obtain a semiconductive resin composition (C). The results of measurements are shown in Table 2.

TABLE 2

| | Ex. 9 | Ex. 10 | Comp. Ex. 3 |
|---|---|---|---|
| Semiconductive resin composition (A) | 100 | — | — |
| Semiconductive resin composition (B) | — | 100 | — |
| Semiconductive resin composition (C) | — | — | 100 |
| Styrene content of resin composition (wt %) | 30 | 29 | 30 |
| Evaluation | | | |
| Peel strength (kg/0.5 inches) | 0.6 | 0.4 | 0.7 |
| Carbon residue | none | none | none |
| Degree of crosslinking (wt %) | 65 | 45 | 3 |
| Percentage deformation under heat and load (%) | 12 | 30 | 78 |

What is claimed is:

1. A semiconductive resin composition comprising the following components (A), (B), (D) and (E):

(A) 5 to 100 parts by weight of a modified ethylene copolymer obtained by subjecting an ethylene copolymer (a1) and a vinyl monomer (a2) to graft polymerization conditions, (B) 0.5 to 15 parts by weight of an unsaturated silane compound, (D) 10 to 110 parts by weight of carbon black, and (E) 0 to 95 parts by weight of an ethylene copolymer, provided that the amounts of the components shown above are based on 100 parts by weight in total of the components (A) and (E), wherein the component (B) is incorporated into the composition by subjecting the component (B) to melt graft reaction together with the component (A) and/or component (E) in the presence of 0.01 to 2 parts by weight of a radical generator (C), the vinyl monomer (a2) unit is contained in the composition in an amount of 5 to 35% by weight of the total amount of the components (A) and (E), and the degree of crosslinking of the composition is from 30 to 90% by weight.

2. The semiconductive resin composition according to claim 1, comprising the following components (A), (B), (D) and (E):

(A) 20 to 80 parts by weight of the modified ethylene copolymer, (B) 0.5 to 15 parts by weight of the unsaturated silane compound, (D) 10 to 110 parts by weight of the carbon black, and (E) 20 to 80 parts by weight of the ethylene copolymer, wherein the component (B) is incorporated into the composition by subjecting the component (B) to melt graft reaction together with the component (A) in the presence of 0.01 to 2 parts by weight of a radical generator (C).

3. The semiconductive resin composition according to claim 1, comprising the following components (A), (B), (D) and (E):

(A) 20 to 80 parts by weight of the modified ethylene copolymer, (B) 0.5 to 15 parts by weight of the unsaturated silane compound, (D) 10 to 110 parts by weight of the carbon black, and (E) 20 to 80 parts by weight of the ethylene copolymer, wherein the component (B) is incorporated into the composition by subjecting the component (B) to melt graft reaction together with the component (E) in the presence of 0.01 to 2 parts by weight of the radical generator (C).

4. The semiconductive resin composition according to claim 1, wherein the component (B) is incorporated into the composition by subjecting the component (B) to melt graft reaction together with the component (A) and/or component (E) in the presence of the radical generator (C) and the component (D).

5. The semiconductive resin composition according to claim 1, wherein the ethylene copolymer (a1) contains 15 to 50% by weight of a monomer/monomers other than ethylene.

6. The semiconductive resin composition according to claim 1, wherein the ethylene copolymer (a1) has a melt flow rate of 0.1 to 300 g/10 min.

7. The semiconductive resin composition according to claim 1, wherein the component (A) contains 10 to 60% by weight of the vinyl monomer (a2) unit.

8. A power cable comprising a core conductor, an internal semiconductive layer, an insulating layer and an external semiconductive layer, said external semiconductive layer comprising the semiconductive resin composition according to claim 1.

9. The power cable according to claim 8, wherein the insulating layer comprises a copolymer of an unsaturated silane compound.

10. The power cable according to claim 9, wherein the copolymer of an unsaturated silane compound is a copolymer of ethylene and an unsaturated silane compound.

* * * * *